US009585496B2

(12) United States Patent
Strassburger et al.

(10) Patent No.: US 9,585,496 B2
(45) Date of Patent: Mar. 7, 2017

(54) JEWELRY DISPLAY HANGER

(71) Applicant: B&G Plastics, Inc., Union, NJ (US)

(72) Inventors: Jake Strassburger, South Plainfield, NJ (US); Daniel V. Cunneen, Waldwick, NJ (US); Keith C. Cedro, Clifton, NJ (US)

(73) Assignee: B&G Plastics, Inc., Union, NJ (US)

( * ) Notice: Subject to any disclaimer, the term of this patent is extended or adjusted under 35 U.S.C. 154(b) by 0 days.

(21) Appl. No.: 14/835,132

(22) Filed: Aug. 25, 2015

(65) Prior Publication Data

US 2016/0058210 A1 Mar. 3, 2016

Related U.S. Application Data

(60) Provisional application No. 62/043,112, filed on Aug. 28, 2014.

(51) Int. Cl.
*A47F 5/00* (2006.01)
*A47F 7/02* (2006.01)

(52) U.S. Cl.
CPC ..... *A47F 5/0006* (2013.01); *A47F 7/02* (2013.01)

(58) Field of Classification Search
CPC .... A47F 7/02; A47F 7/03; A47F 7/024; A47F 7/022; A47F 5/0006; A47F 5/04; A47F 5/02; A47F 3/14; A47F 3/005; A47F 5/0807; A47F 5/0846; A47F 5/0892; A47F 5/0025; A47F 5/0861; A47F 5/112; F16B 45/00; F16B 45/02; F16B 35/06; F16B 2/12; F16B 37/045; F16B 45/06; F16B 2/065; F16B 35/041; F16B 2001/0035; F16B 47/00; F16B 15/00; F16B 2/06; F16B 2/22; F16B 5/0685; F16B 5/0692
USPC ..... 248/301, 339, 340; 211/85.2; 223/87; 206/6.1, 289, 292, 293
See application file for complete search history.

(56) References Cited

U.S. PATENT DOCUMENTS

| | | | | |
|---|---|---|---|---|
| 3,085,725 | A * | 4/1963 | Caparosa | A47G 25/743 2/145 |
| 3,456,853 | A * | 7/1969 | Hodge | A47G 25/743 2/153 |
| 3,592,343 | A * | 7/1971 | Swett | A47G 25/743 211/113 |
| 4,714,156 | A | 12/1987 | Kolton et al. | |
| 4,765,467 | A | 8/1988 | Kolton et al. | |
| 4,768,649 | A | 9/1988 | Kolton et al. | |
| 4,930,692 | A | 6/1990 | Smilow et al. | |
| 5,110,019 | A | 5/1992 | Kolton et al. | |
| 5,123,577 | A | 6/1992 | Kolton et al. | |

(Continued)

*Primary Examiner* — Steven Marsh
(74) *Attorney, Agent, or Firm* — Hoffmann & Baron, LLP

(57) ABSTRACT

A jewelry display hanger is provided that has a body, a hook, a neck, a base and a flap. The body has a hook on a first end and two sides extending outwardly to a second end. The neck extends from the second end of the body and connects to the base, which has first and second arms. First and second recesses are formed between the arms and the second end of the body. Each of the arms has at least one slot that extends between one of the recesses and an aperture. The flap extends downwardly from the base and has a closure device near its distal end. The closure device is detachably affixed in an aperture in the base or neck to secure the distal end of the flap to the base or neck for attaching the hanger to an article of jewelry.

19 Claims, 3 Drawing Sheets

(56) References Cited

U.S. PATENT DOCUMENTS

| | | | | |
|---|---|---|---|---|
| 5,222,638 | A | 6/1993 | Kolton et al. | |
| 5,328,065 | A | 7/1994 | Kolton et al. | |
| 5,501,378 | A | 3/1996 | Kolton et al. | |
| 5,582,387 | A | 12/1996 | Kolton et al. | |
| 5,615,810 | A | 4/1997 | Kolton et al. | |
| 5,826,760 | A | 10/1998 | Kolton et al. | |
| 5,857,597 | A * | 1/1999 | Kolton | A47G 25/743 150/131 |
| 5,988,462 | A | 11/1999 | Kolton | |
| 6,206,253 | B1 | 3/2001 | Kolton et al. | |
| 6,264,077 | B1 | 7/2001 | Kolton et al. | |
| 6,561,358 | B2 | 5/2003 | Kolton et al. | |
| 7,143,892 | B2 | 12/2006 | Kolton et al. | |
| 7,328,821 | B2 * | 2/2008 | Dedo | A47G 25/20 223/85 |
| 7,448,520 | B2 | 11/2008 | Kolton et al. | |
| 8,286,882 | B2 | 10/2012 | Norman et al. | |
| 8,308,291 | B2 | 11/2012 | Norman et al. | |
| 8,651,344 | B2 | 2/2014 | Norman et al. | |

* cited by examiner

JEWELRY DISPLAY HANGER

This application claims priority from provisional application Ser. No. 62/043,112, filed on Aug. 28, 2014, which is incorporated herein in its entirety.

FIELD OF THE INVENTION

The present invention relates to hangers that are used in the packaging and display of jewelry. In particular, the present invention relates to hangers that are secured to one or more pieces of jewelry and hung from merchandise displays.

BACKGROUND OF THE INVENTION

Small articles, such as jewelry, are commonly displayed for sale in retail stores on racks or in display cases where the articles are hung. A variety of different hangers and tags have been used that are secured to the article and have a means for attaching the article to the rack for display. Several of the criteria for designing these hangers relate to the cost of manufacturing the hangers and the cost of attaching them to the articles. Another important design consideration is that the hangers must be convenient for the merchant to display and they must be convenient for the customer to remove after purchase.

Hangers used for displaying jewelry, such as earrings, bracelets and necklaces, must be designed so that the customer can easily view the jewelry and remove the hanger from the display rack. The hangers must also be designed so that the customer can easily remove the hanger to try on the jewelry. Because a customer may try on several pieces of jewelry before making a selection, the hangers must be designed so that they can be removed and then reinstalled on the rack by the customer numerous times without damaging either the jewelry or the hangers.

Accordingly, there is a need for a hanger for displaying jewelry that can be easily removed and reinstalled in the display and that does not prevent the jewelry from being worn by a customer. There is also a need for a hanger for displaying jewelry that can be economically manufactured and easily and firmly secured to the jewelry.

SUMMARY OF THE INVENTION

In accordance with the present invention, a jewelry display hanger is provided. The jewelry display hanger comprises, consists of or consists essentially of a hook, a body, a neck, a base and an attachable/detachable flap. The body is substantially flat and has a longitudinal axis extending between the first and second ends. The hook is on the first end and first and second sides extend outwardly from the longitudinal axis between the first and second ends. The neck extends from the second end of the body along the longitudinal axis and connects the base to the body. The base includes first and second arms and the first and second arms that extend perpendicularly to the neck to first and second distal ends. The neck, base and arms are substantially flat and in the same plane as the body. There is at least one aperture in the base or neck. In one embodiment, the first and second distal ends of the arms do not extend beyond the first and second sides, respectively, of the body. In another embodiment, the first and second distal ends of the arms extend beyond the first and second sides, respectively, of the body.

The attachable/detachable flexible flap extends along the longitudinal axis from a side of the base opposite the neck to a distal end. The flap has a closure device near the distal end that is detachably affixed in the at least one aperture in the base or neck to secure the distal end so that the hanger can be attached to an article of jewelry. Preferably, the closure device extends from a surface on one side of the flap.

The jewelry display hanger can also include first and second recesses formed on the opposing sides of the hanger between the first and second arms, respectively, and the second end of the body. Each of the arms has at least one slot that is in communication with the first or second recess and each of the slots extends from the first or second recess to first or second apertures, respectively. The slots and apertures are adapted to receive a necklace, a bracelet, a pair of earrings or other types of jewelry. Preferably, the first and second arms are made from a resilient material so that, when the jewelry item passes through the slot, the slot retains its shape so that the jewelry item is secured in the aperture.

BRIEF DESCRIPTION OF THE FIGURES

The preferred embodiments of the jewelry display hanger of the present invention, as well as other objects, features and advantages of this invention, will be apparent from the accompanying drawings wherein.

DETAILED DESCRIPTION OF THE INVENTION

The present invention is a jewelry display hanger having a hook, a body connected to a base by a neck and an attachable/detachable flap. In general, the hanger body has the shape of an isosceles trapezoid with the top of the hook on the first end and the second end of the hanger on the bottom substantially parallel and with the two sides extending outwardly between the first and second ends. The hook is at the first end of the substantially flat body and the two sides of the body extend downwardly and outwardly from the hook to a second end. The front and rear surfaces of the body can include logos, product descriptions or pricing information, including bar codes. The neck extends from the second end of the body opposite the hook and connects to the base, which has first and second arms extending perpendicular to the base to first and second distal ends. The base is in the same plane as the body so that the hangar is substantially flat. First and second recesses are formed by the first and second arms and the second end of the body. Each of the arms has at least one slot that is in communication with the first or second recess and the base or neck has at least one aperture. In a preferred embodiment, the first and second slots extend from the first and second recesses to first and second apertures, respectively.

The flap extends downwardly from the base and has a closure device near its distal end. The flap can be folded around a piece of jewelry, such as a necklace or chain, and the closure device can then be detachably affixed in the at least one aperture to secure the distal end to the base or neck. The sides of the body can extend beyond the distal ends of the first and second arms or the distal ends of the first and second arms can extend beyond the first and second sides of the body. The slots and apertures in the arms can be used to secure different types of jewelry, such as necklaces, bracelets and earrings to the hanger. Preferably, the arms are formed from a resilient material so that the slot expands to allow the jewelry to pass through to the aperture and then returns to its normal configuration. This also prevents the jewelry from easily separating from the hanger when a customer is viewing multiple jewelry items in a display rack.

Figure 3:
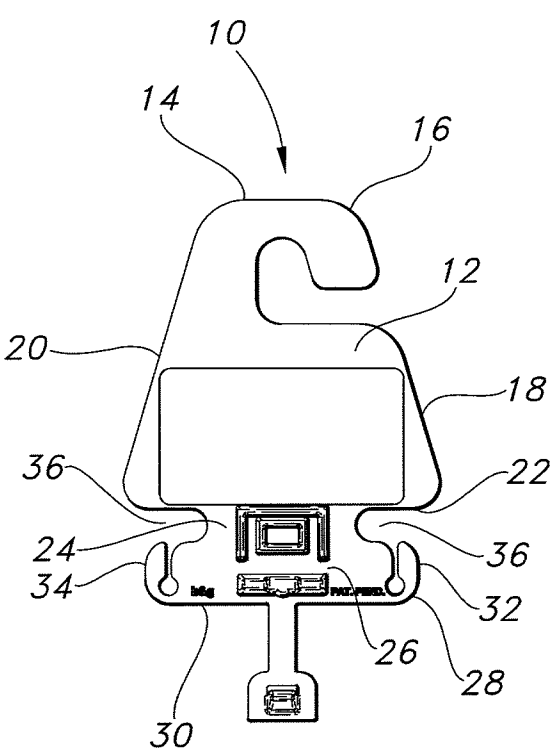
FIG. 3 is a rear view of the jewelry display hanger shown in FIG. 1.
Figure 2:
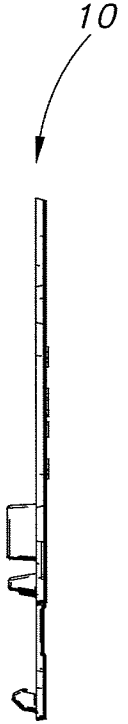
FIG. 2 is a side view of the jewelry display hanger shown in FIG. 1.
Figure 1:
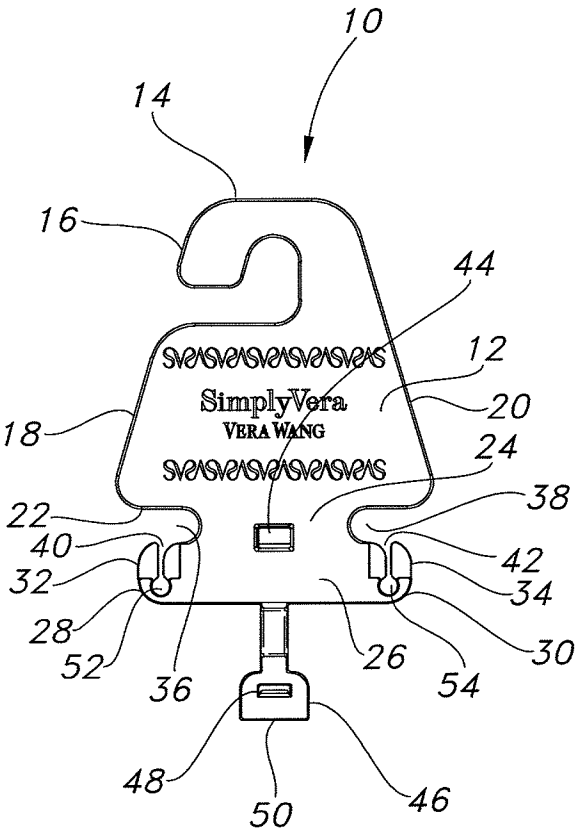
FIG. 1 is a front view of a first embodiment of the jewelry display hanger having a hook, a body with a pair of arms and an attachable flap.
Figure 6:
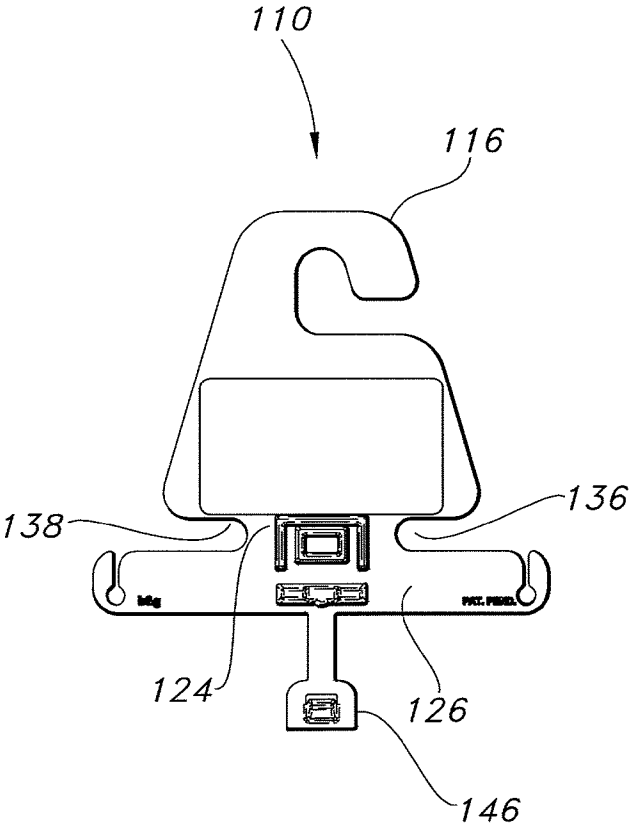
FIG. 6 is a rear view of the jewelry display hanger shown in FIG. 4.
Figure 5:
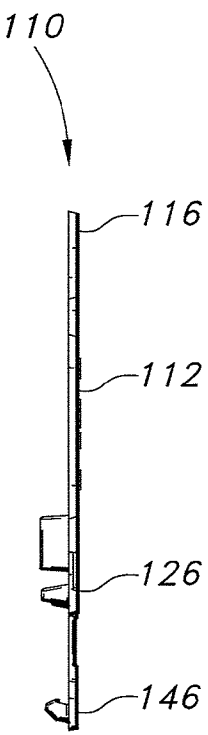
FIG. 5 is a side view of the jewelry display hanger shown in FIG. 4.
Figure 4:
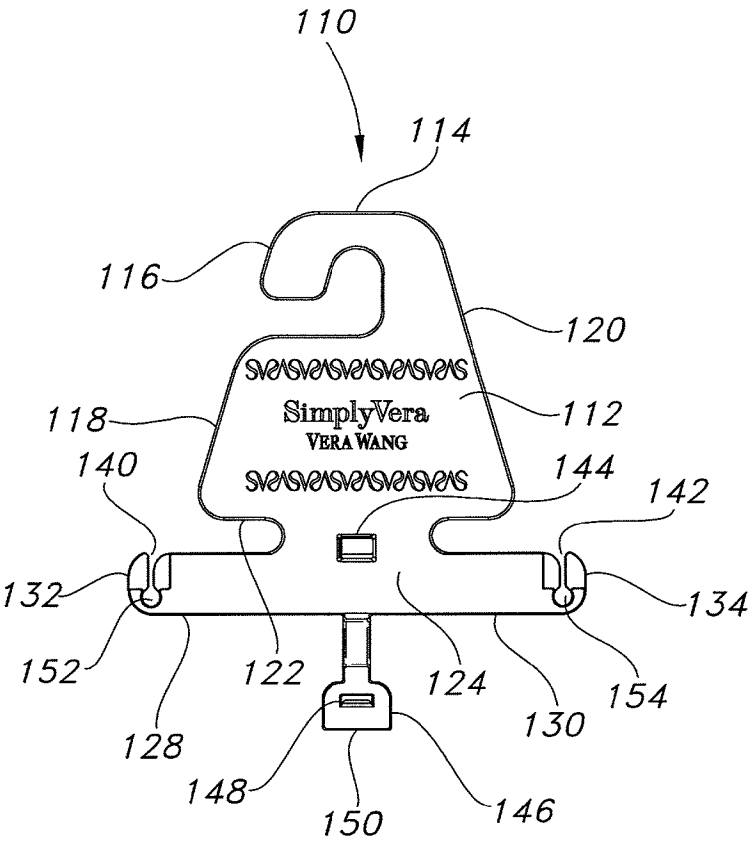
FIG. 4 is a front view of a second embodiment of the jewelry display hanger having a hook, a body with a pair of arms extending beyond the body and an attachable flap.
Figure 7:
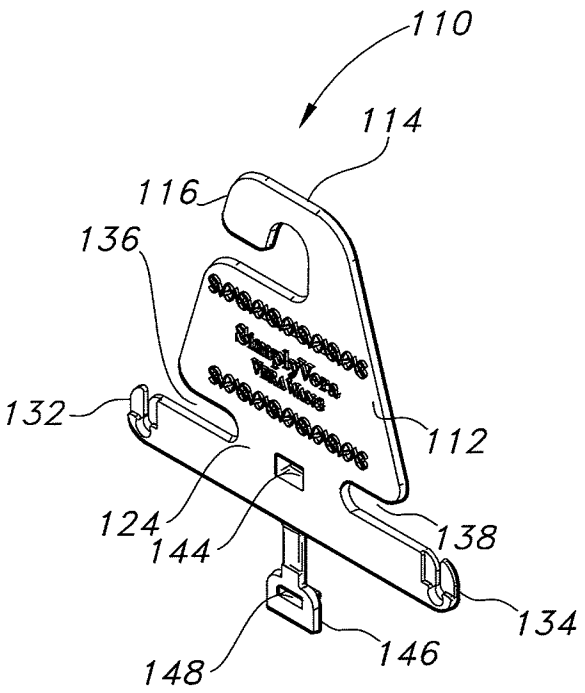
FIG. 7 is a perspective view of the jewelry display hanger shown in FIG. 4.

Referring now to the drawings, FIGS. 1-3 show an embodiment of the jewelry display hanger 10 with a substantially flat body 12 having a first end 14 with a hook 16 and two sides 18, 20 extending outwardly from the first end 14 to a second end 22. A neck 24 extends from the second end 22 and connects a base 26 to the body 12. The base 26 has first and second arms 28, 30 that extend perpendicularly from the neck 24 to first and second distal ends 32, 34. First and second recesses 36, 38 on opposing sides of the hanger 10 are formed between the first and second arms 28, 30 and the second end 22 of the body 12. Each of the arms 28, 30 has a slot 40, 42 that is in communication with the first and second recesses 36, 38. The slots 40, 42 extend from the first and second recesses 36, 38 to first and second apertures 52, 54, respectively.

The base 26 or neck 24 has at least one aperture 44. An attachable/detachable flap 46 extends downwardly from the base 26 along the longitudinal axis of the hanger 10 and has a closure device 48 near its distal end 50. The closure device 48 is detachably affixed in the aperture 44 to secure the distal end 50 to the base 26 or neck 24 for attaching the hanger 10 to an article of jewelry (not shown).

FIGS. 4-7 show another embodiment of the jewelry display hanger 110 that is substantially the same as the first embodiment shown in FIGS. 1-3, except the first and second arms 128, 130 extend beyond the first and second sides 118, 120. In the embodiment shown in FIGS. 4-7, the jewelry display hanger 110 has a substantially flat body 112. The body 112 has a first end 114 with a hook 116 and two sides 118, 120 extending outwardly from the first end 114 to a second end 122. A neck 124 extends from the second end 122 and connects a base 126 to the body 112. The base 126 has first and second arms 128, 130 that extend perpendicularly from the neck 124 to first and second distal ends 132, 134. First and second recesses 136, 138 on opposing sides of the hanger 110 are formed between the first and second arms 128, 130 and the second end 122 of the body 112. Each of the arms 128, 130 has a slot 140, 142 that is in communication with the first and second recesses 136, 138. The slots 140, 142 extend from the first and second recesses 136, 138 to first and second apertures 152, 154, respectively.

The base 126 or neck 124 has at least one aperture 144. An attachable/detachable flap 146 extends downwardly from the base 126 along the longitudinal axis of the hanger 110 and has a closure device 148 near its distal end 150. The closure device 148 is detachably affixed in the aperture 144 to secure the distal end 150 to the base 126 or neck 124 for attaching the hanger 110 to an article of jewelry (not shown).

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A jewelry display hanger comprising:

a substantially flat body having a longitudinal axis, a hook on a first end and first and second sides, wherein the first and second sides extend outwardly from the longitudinal axis between the first end and a second end;

a neck extending from the second end along the longitudinal axis;

a base connected by the neck to the body and comprising first and second arms, wherein the base and arms are substantially flat and in the same plane as the body and the first and second arms extend perpendicularly to the neck to first and second distal ends, and wherein the first and second distal ends do not extend beyond the first and second sides, respectively, of the body;

at least one aperture in the base or neck; and an attachable/detachable flexible flap extending along the longitudinal axis from a side of the base opposite the neck to a distal end, wherein the flap has a closure device near the distal end, and wherein the closure device is detachably affixed in the at least one aperture to secure the distal end to the base or neck for attaching the hanger to an article of jewelry.

2. The jewelry display hanger according to claim 1, further comprising first and second recesses formed on the opposing sides of the hanger between the first and second arms, respectively, and the second end of the body, wherein each of the arms has at least one slot that is in communication with the first or second recess.

3. The jewelry display hanger according to claim 2, wherein each of the slots in the first or second arms extends from the first or second recess to first or second apertures, respectively.

4. The jewelry display hanger according to claim 3, wherein the slots and apertures are adapted to receive a necklace, bracelet or a pair of earrings.

5. The jewelry display hanger according to claim 1, wherein the closure device extends from a surface on one side of the flap.

6. The jewelry display hanger according to claim 1, wherein the first and second arms are made from a resilient material.

7. A jewelry display hanger comprising:

a substantially flat body having a longitudinal axis, a hook on a first end and two sides, wherein the two sides extend outwardly from the longitudinal axis between the first end and a second end;

a neck extending from the second end along the longitudinal axis;

a base connected by the neck to the body and comprising first and second arms, wherein the base is substantially flat and in the same plane as the body and the first and second arms extend perpendicularly from the neck to first and second distal ends;

an attachable/detachable flap extending from the base along the longitudinal axis to a distal end for attaching the hanger to an article of jewelry; and first and second recesses formed on the opposing sides of the hanger between the first and second arms, respectively, and the second end of the body, wherein the first and second arms have first and second slots, respectively, in communication with the first and second recesses.

8. The jewelry display hanger according to claim 7, wherein the first and second slots extend from the first and second recesses to first and second apertures, respectively.

9. The jewelry display hanger according to claim 7, wherein the first and second arms extend beyond the first and second sides of the body, respectively.

10. The jewelry display hanger according to claim 7, wherein the base or neck has at least one aperture.

11. The jewelry display hanger according to claim 10 further comprising a closure device near the distal end of the attachable/detachable flap, wherein the closure device is detachably affixed in the at least one aperture to secure the distal end to the base or neck.

12. The jewelry display hanger according to claim 7, wherein the first and second arms are made from a resilient material.

13. A jewelry display hanger comprising:

a substantially flat body having a longitudinal axis, a hook on a first end and first and second sides, wherein the first and second sides extend outwardly from the longitudinal axis between the first end and a second end;

a neck extending from the second end along the longitudinal axis;

a base connected by the neck to the body and comprising first and second arms, wherein the base and arms are substantially flat and in the same plane as the body and the first and second arms extend perpendicularly to the neck to first and second distal ends, and wherein the first and second arms are made from a resilient material;

first and second recesses formed on the opposing sides of the hanger between the first and second arms, respectively, and the second end of the body;

at least one aperture in the base or neck; and an attachable/detachable flexible flap extending along the longitudinal axis from a side of the base opposite the neck to a distal end, wherein the flap has a closure device near the distal end, and wherein the closure device is detachably affixed in the at least one aperture to secure the distal end to the base or neck for attaching the hanger to an article of jewelry.

14. The jewelry display hanger according to claim 13, wherein each of the arms has at least one slot that is in communication with the first or second recess.

15. The jewelry display hanger according to claim 14, wherein each of the slots in the first or second arms extends from the first or second recess to first or second apertures, respectively.

16. The jewelry display hanger according to claim 15, wherein the slots and apertures are adapted to receive a necklace, bracelet or a pair of earrings.

17. The jewelry display hanger according to claim 13, wherein the closure device extends from a surface on one side of the flap.

18. The jewelry display hanger according to claim 13, wherein the distal ends of the arms extend beyond the first and second sides of the body.

19. The jewelry display hanger according to claim 13, wherein the distal ends of the arms do not extend beyond the first and second sides of the body.

* * * * *